US005535580A

United States Patent [19]

Sebastian et al.

[11] Patent Number: 5,535,580

[45] Date of Patent: Jul. 16, 1996

[54] PROCESS AND DEVICE FOR PIECING ON AN OPEN-END SPINNING DEVICE

[75] Inventors: Brandl Sebastian, Böhmfeld; Susanne Messmer, Ingolstadt; Lindner Gallus, Kinding, all of Germany

[73] Assignee: Rieter Ingolstadt Spinnereimaschinenbau AG, Ingolstadt, Germany

[21] Appl. No.: 385,149

[22] Filed: Feb. 7, 1995

[30] Foreign Application Priority Data

Feb. 12, 1994 [DE] Germany ..... 44 04 538.7

[51] Int. Cl.[6] ..... D01H 4/50

[52] U.S. Cl. ..... 57/263; 57/301; 57/304; 57/409

[58] Field of Search ..... 57/263, 301, 302, 57/304, 408, 409, 411, 413

[56] References Cited

U.S. PATENT DOCUMENTS

| | | | |
|---|---|---|---|
| 3,354,631 | 11/1967 | Elias et al. | 57/263 |
| 3,521,440 | 7/1970 | Oskin et al. | 57/405 |
| 3,728,853 | 4/1973 | Schiltknecht | 57/405 |
| 3,791,128 | 2/1974 | Landwehrkamp et al. | 57/263 |
| 3,842,579 | 10/1974 | Bartling | 57/263 |
| 3,892,062 | 7/1975 | Stahlecker et al. | 57/263 |
| 3,953,961 | 5/1976 | Harrap et al. | 57/264 |
| 4,020,621 | 5/1977 | Tsubata | 57/263 |
| 4,047,371 | 9/1977 | Stahlecker | 57/263 |
| 4,055,942 | 11/1977 | Stahlecker | 57/263 |
| 4,059,946 | 11/1977 | Bottcher et al. | 57/263 |
| 4,109,453 | 8/1978 | Kobayashi et al. | 57/411 |
| 4,150,530 | 4/1979 | Derichs | 57/263 |
| 4,163,359 | 8/1979 | Honjo | 57/93 |
| 4,175,370 | 11/1979 | Stahlecker | 57/263 |
| 4,178,749 | 12/1979 | Stahlecker et al. | 57/263 |
| 4,384,451 | 5/1983 | Elias et al. | 57/263 |
| 4,395,870 | 8/1983 | Neher et al. | 57/263 |
| 4,489,544 | 12/1984 | Morita et al. | 57/261 |
| 4,495,762 | 1/1985 | Junek et al. | 57/411 |
| 4,497,166 | 2/1985 | Artzt et al. | 57/263 |
| 4,633,660 | 1/1987 | Artzt et al. | 57/263 |
| 4,644,742 | 2/1987 | Lovas et al. | 57/263 |
| 4,676,059 | 6/1987 | Artzt et al. | 57/263 |
| 4,712,367 | 12/1987 | Lassmann | 57/263 |
| 4,760,688 | 8/1988 | Beitzinger | 57/92 |
| 4,825,631 | 5/1989 | Raasch | 57/263 |
| 4,825,632 | 5/1989 | Raasch et al. | 57/263 X |
| 4,838,018 | 6/1989 | Hoeber | 57/263 |
| 4,893,462 | 1/1990 | Braun et al. | 57/302 |
| 4,899,528 | 2/1990 | Fahmuller et al. | 57/92 |
| 4,901,519 | 2/1990 | Wassenhoven et al. | 57/411 |
| 4,976,099 | 12/1990 | Brockmanns et al. | 57/411 |
| 4,998,404 | 3/1991 | Ferro et al. | 57/263 |
| 5,191,760 | 3/1993 | Ball et al. | 57/263 |
| 5,243,812 | 9/1993 | Strobel et al. | 57/263 |
| 5,331,798 | 7/1994 | Ball et al. | 57/263 |
| 5,463,860 | 11/1995 | Sauer | 57/263 |

FOREIGN PATENT DOCUMENTS

| | | |
|---|---|---|
| 42906 | 1/1982 | European Pat. Off. . |
| 3516120A1 | 11/1986 | Germany . |
| 71433 | 4/1984 | Japan . |
| 1228534 | 4/1971 | United Kingdom . |
| 1296461 | 11/1972 | United Kingdom . |
| 2044807 | 10/1980 | United Kingdom . |

*Primary Examiner*—Joseph J. Hail, III
*Attorney, Agent, or Firm*—Dority & Manning

[57] ABSTRACT

A process and device for piecing in an open-end spinning device includes switching on a fiber feeding device for a predetermined period of time so that fibers which are undesired for piecing are combed out of the leading end of the fiber sliver which is presented to an opener device. The combed out fibers are deflected from the fiber collection surface. The fiber feeding device is switched off after the predetermined period of time once the undesired fibers have been combed out and is maintained in an off condition for a short period of time so that the fibers remaining in the leading end of the fiber silver are only minimally damaged by the opener device. The fiber feeding device is switched back on and the fiber stream is deflected from the fiber collection surface as the stream increases to full strength. The fiber stream is subsequently deflected to the fiber collection surface for piecing in coordination with backfeeding of a yarn end to the fiber collection surface.

15 Claims, 5 Drawing Sheets

PROCESS AND DEVICE FOR PIECING ON AN OPEN-END SPINNING DEVICE

BACKGROUND OF THE INVENTION

The instant invention relates to a process for piecing on an open-end spinning device with a fiber collection surface in which a fiber feeding device feeding a fiber sliver to an opener device is switched on and the fiber stream thus produced is deflected from its path between the fiber feeding device and the fiber collection surface and is removed until the actual piecing process by back-feeding of a yarn, which is later to be withdrawn again, is initiated while the fiber stream is still increasing, whereupon the fiber stream is again deflected in coordination with this back-feeding and is fed to the fiber collection surface even before having reached its full strength, as well as to a device to carry out this process.

Such a process is known from DE 39 03 782 A1. It is thereby possible to enable a gradual running up of the yarn withdrawal in spite of the sudden deflection of a fiber stream started previously by switching on the fiber feeding device without any significant deviation in yarn thickness resulting from this, as this deflection and the feeding of the fiber stream to the fiber collection surface take place at a point in time when the fiber stream has not yet reached its full strength and therefore continues to increase. It has been shown however that in spite of extensive adaptation of the fiber withdrawal to the action of the fiber stream in the spinning rotor, satisfactory piecing joints cannot always be obtained.

OBJECTS AND SUMMARY OF THE INVENTION

It is therefore a principal object of the instant invention to create a process and a device which avoid the disadvantages of the known device and thus make it possible to produce better piecing joints. Additional objects and advantages of the invention will be set forth in the following description, or may be obvious from the description, or may be learned through practice of the invention.

The objects are attained through the invention in that the fiber feeding device is momentarily switched on, before being switched on for the actual piecing process, for a period of time allowing fibers which are undesirable for piecing to be combed out of the leading end of the fiber sliver, whereby these combed-out fibers are prevented from collecting on the fiber collection surface and are removed, in that the fiber feeding device is then stopped for a sufficient time span so that the number of fibers combed out per time unit remains on the one hand essentially constant and for the fibers still remaining in the leading end of the fiber sliver to be affected on the other hand only to a minimal extent by abrasion and/or ravelling, in that the fiber feeding device is then switched on again and the fibers continue at first to be removed before the full strength of the fiber stream has been reached until the fibers which were minimally affected during the new stoppage of the fiber feeding device and are therefore undesirable have been substantially removed, the still increasing fiber stream being fed only then to the fiber collection surface.

The momentary launching of the fiber feeding device even before the beginning of the actual piecing process not only causes the fibers which were shortened during the preceding stoppage of the fiber feeding device to be removed from the fiber sliver, but in addition, tangling or intertwining or other ravelling of fibers which may have been caused by heat due to the continued running of the opener device during the stoppage of the fiber feeding device is eliminated. The fiber feeding device then remains switched on until all these fibers which are unsuitable and undesirable for piecing are removed from the fiber tuft. These fibers which are combed out of the leading end of the fiber sliver, the so-called fiber tuft, are removed and are thus prevented from collecting on the fiber collection surface so that they cannot be incorporated into the yarn which is subsequently spun.

When the fiber feeding device is switched off again, the number of fibers combed out of the fiber tuft or abraded from it decreases until the number of combed-out fibers finally remains nearly constant. The fiber feeding device is now switched back on early enough so that no significant damage is yet inflicted on the fibers following the stoppage of the momentarily switched-on fiber feeding device. This damage merely affects a very short segment of the fiber sliver. Thanks to the brief removal of even these fibers released after again switching on the fiber feeding device, said fibers being undesirable for piecing, perfect fibers are available for the piecing process when the fiber stream is fed to the fiber collection surface by being switched over. In addition, yarn withdrawal can easily be adapted to the increasing fiber stream acting upon the fiber collection surface since the fiber stream is switched over to end fiber removal and the fibers are conveyed to the fiber collection surface even before the fiber stream has reached its full strength following release by the fiber collection surface, this being its strength during normal production, and is therefore itself still in the process of increasing.

A method is known by which the fiber feeding device is momentarily switched on before final launching and is then switched off for a defined period of time (DE 24 58 042 A1). The purpose in this case is to produce a fiber tuft which always occurs with the same configuration and which then makes it possible to dose the fiber quantity fed exactly. The intention is to make available a given piecing quantity in the form of a fiber ring which is to be incorporated into the back-fed yarn. It has been shown, however, that the combing-out curves are different depending on the material so that, in order to obtain a given residual fiber quantity in the fiber tuft, a separate stoppage period must be determined for each fiber material to be spun. This disadvantage is avoided by the instant invention in that the stoppage time is selected so that the combing out has already been reduced to such an extent that the fibers combed out per time unit remain nearly constant. Within this range there are no longer any great differences when combing out different materials, so that the same starting conditions are created for the running up of the fiber flow which is produced by again switching on the fiber feeding device. By contrast with the state of the art, the fibers combed out after switching on the fiber feeding device are also not used to form a fiber ring because the latter would receive the fibers combed out and partly shortened as a result of being combed out during the stoppage, even if brief, of the fiber feeding device after being switched on momentarily. These shortened fibers affect the strength of the piecing joint and are therefore unsuitable or at least undesirable for the piecing process. They are therefore not used for the piecing process according to the instant invention but are prevented from such use by being removed.

To ensure that all previously damaged or otherwise affected fibers have been taken off and removed from the leading end of the fiber sliver during the momentary operation of the fiber feeding device, it is possible to select a switching-on time of sufficient duration so that a sliver segment of sufficient length is fed to the fiber feeding device to ensure that a perfect sliver segment is present in the fiber feeding device in any case. This means however that a period of time of often unnecessary length is required for this. In order to keep the time of momentary operation of the fiber feeding device as brief as possible, an advantageous embodiment of the process according to the invention provides for the duration of the momentary operation of the fiber feeding device to be determined as a function of the time during which the opener device has an effect on the leading end of the fiber sliver which has been stopped as a result of stopping the fiber feeding device before the beginning of the momentary operation of said fiber feeding device. Since the impairment of the fiber tuft and the length of the impaired segment of the fiber sliver, and hence of the fibers which it contains, increases with the duration of the stoppage period of the fiber feeding device while the opener equipment continues to run and decreases as this stoppage period decreases, it is possible to determine the switched-on period so that it does not exceed the necessary duration by taking this stoppage period into account in the duration of the switching-on time of the fiber feeding device. This results in shortening the piecing process especially in the case of brief stoppage periods of the fiber feeding device while the opener equipment continues to run.

In another advantageous embodiment of the process according to the invention, the duration of the momentary operation of the fiber feeding device is determined as a function of the state of the leading end of the fiber tuft before the beginning of the momentary operation of the fiber feeding device. In this manner the impairment of the fibers contained in the fiber tuft is ascertained not indirectly over a period of time, but by direct examination of the leading end of the fiber tuft and is used as a basis for the time during which the fiber feeding device is switched on.

As has already been explained above, different materials used for spinning (type of material and fiber length) produce different combing-out behaviors. It is therefore absolutely possible that when a certain material is combed out, the number of fibers combed out per time unit remains already constant after a predetermined time span while it continues to decrease with another material. To always achieve the same starting conditions for the starting of the fiber flow, independently of the material to be spun at the time, so that essentially the same conditions prevail at the moment when fiber deflection and removal is ended, it is advantageous for the period of time during which the fiber feeding device is again switched off after its momentarily being switched on to be selected always of the same duration, independently of the material to be spun, in such a manner that the number of fibers combed out per time unit remains constant at the time of switching the fiber feeding device back on, independently of the material to be spun.

The process can be realized in detail in different manners. In a process in which the fibers fed to the fiber collection surface are fed through a fiber feeding channel and where the fiber collection surface is made in the form of a fiber collection groove in a spinning rotor with an open border from which a spun yarn is withdrawn through a fiber withdrawal pipe which is coaxial with the spinning rotor, the yarn is advantageously brought by the combined action of the negative spinning pressure and the auxiliary suction air stream into a readiness position within the fiber withdrawal pipe according to the invention while the spinning rotor is stopped and before the fiber feeding device is momentarily switched on and the fibers which are thus released are removed, and the negative spinning pressure is then shut off in coordination therewith and the yarn is released and is now sucked into the fiber feeding channel under the action of the auxiliary suction air stream while the fibers continue to be removed without coming into contact with the yarn, the spinning rotor is started again and the fiber feeding device which had been switched off in the meantime while the auxiliary suction stream continues to flow is switched on again, whereupon the fibers and the yarn are fed to the fiber collection groove by switching the negative spinning pressure back on and switching off the auxiliary suction air flow while the fiber flow increases, said fibers being incorporated at the fiber collection groove into the end of the yarn which is now withdrawn continuously. This not only ensured that a fiber quantity which can be determined precisely will be available for the piecing of the yarn but, in addition the back-feeding of the yarn end to the fiber collection surface, is optimally adapted to the fiber feeding to the fiber collection surface.

In an advantageous embodiment of the process in which the fiber collection surface is made in the form of a fiber collection groove in a spinning rotor with an open border, whereby a flow of suction air can be produced which leaves the spinning rotor via its open border, it has been shown to be advantageous for the fibers which are combed out of the leading end of the fiber sliver during the momentary launching period of the fiber feeding device are sucked away over the open border of the spinning rotor. In this manner it is possible to feed the yarn back to the fiber collection surface for piecing with a time offset relative to fiber feeding to the fiber collection surface.

In a further development of this process, the deflection of the fiber stream from its path between the fiber feeding device and the fiber collection surface starts after shutting off the previously momentarily launched fiber feeding device and before renewed switching-on of the fiber feeding device. When the fiber collection surface is driven during spinning, the deflection of the fiber stream from its path between the fiber feeding device to the fiber collection surface starts in an advantageous further development of the process according to the invention before the previously stopped fiber collection surface is restarted. This ensures that none of the fibers combed out last and which are not desirable for piecing may settle on the driven fiber collection surface but are removed reliably because of the deflection.

It has already been explained above that the fiber stream produced by renewed switching-on of the fiber feeding device is not fed immediately to the fiber collection surface but only later, but still early enough so that its full strength has not yet been reached. Since it is known to what extent the fiber tuft has been damaged or impaired during the defined stoppage period between the end of the momentary launching of the fiber feeding device and the restarting of the fiber feeding device, a simple and advantageous further development of the process according to the invention provides for the time from restarting the fiber feeding device until the feeding of the fiber stream to the fiber collection surface to be determined as a function of the fiber sliver length being fed. Alternatively, or in addition thereto, it is however also possible to provide for the time from restarting the fiber feeding device until the feeding of the fiber stream to the fiber collection surface to be determined as a function of the fiber material. As indicated above, the combing-out curves are different, depending on the material to be spun, so that the running-up curves of the newly started fiber stream are accordingly different. For this reason the varying impact of the fiber material in the fiber sliver length to be measured is taken into account or, alternatively, is used alone to calculate the time during which the removal of the fibers is to be stopped so that they are now fed to the fiber collection surface.

Another, especially advantageous further development of the process according to the instant invention, provides for the yarn to be monitored and for the time from restarting the fiber feeding device until the feeding of the fiber stream to the fiber collection to be controlled as a function of the success obtained in completing the piecing joint. Piecing is thus automatically optimized.

The process according to the instant invention ensures that, first of all, a fiber flow with an intensity and intensity increase that is substantially known is available during piecing, so that the point in time when the previously deflected fiber flow is fed to the fiber collection surface for piecing can be determined optimally. It may be enough, for many purposes, to determine an acceleration curve for the yarn withdrawal which substantially follows the average increase of the fiber flow. But since the fibers are released differently by the fiber feeding device as a function of various factors such as circumferential speed of the fiber feeding device (feed roller), type of fiber material, fiber length, etc., and thus result in fiber streams that increase differently in spite of an identical starting basis (essentially a constant number of fibers combed out per time unit), it is advantageous for a further development of the process according to the invention to provide that the withdrawal of the newly pieced yarn be controlled as a function of the increase of the intensity of the fiber flow on the fiber collection surface. This makes it possible for the yarn which follows the piecing joint to be substantially of the same strength (cross-section) as the normal yarn.

To carry out this process, a device for piecing in an open-end spinning device is used, said open-end spinning device being provided with a fiber collection surface, with a fiber feeding device that can be switched on and off, with opener equipment, with a fiber deflection device located between the fiber feeding device and the fiber collection surface which feeds a fiber stream produced by switching on the fiber feeding device in its fiber stream starting position to the fiber feeding surface and in its fiber stream deflection position to a fiber removal device and which is connected to a control device, with a fiber back-feeding device and with a fiber withdrawal device in which the controls are provided with time controls according to the invention which switch the fiber feeding device on for a predetermined period of time and thereupon switch it off again for a predetermined period of time whereupon they switch it on again and which bring the fiber deflection device back into its fiber stream starting position in synchronization with the switching on and/or off of the fiber feeding device. With such a design of the object of the invention the fiber flow can be controlled and used in such manner for piecing that an unobtrusive piecing joint of great strength can be produced.

Since the running up of the fiber stream varies as a function of various factors in spite of an identical starting basis with respect to the number of fibers combed out per time unit, an advantageous further development of the invention provides for input means to be assigned to the controls in the form of a computer, or containing a computer, which corrects times set in the time control based on the values entered by through the input means.

It is assumed in that case that the time controls are in principle already set for certain times (by a basic program or a previous, manual input) which are then corrected upward or downward by the input of the listed values. All those values which may influence the running-up curve of the fiber flow, e.g. type of material (cotton, synthetics, etc.), fiber length, fiber feeding speed, etc. can then be entered through input means. The means to enter circumferential speed of the fiber feeding device (fiber sliver feeding) speed may consist in this case of the device by which the speed of this fiber feeding device is set, so that a second input device is not required. Alternatively it is however also possible to provide input means assigned to the controls in the form of a computer or containing a computer which determines the times for the time controls by means of the adjusting device.

In another advantageous further development of the device according to the instant invention, a device with automatic controls can be provided instead of a manual input of corrections (directly in the form of time correction data or indirectly by indicating fiber length, material, etc.) by providing a yarn monitoring device which monitors the yarn for thickness fluctuations and which is connected for control to the control device which determines the times for the time controls as a function of the success obtained in completing the piecing joint.

The process and the device according to the instant invention lead to an improvement of the piecing joints with respect to strength as well as aspect. This is achieved in that on the one hand identical combing-out conditions are created before the fiber feeding device is switched on for piecing, and on the other hand in that the fibers released during the brief stoppage of the fiber feeding device following the momentary operation of this device, and which have suffered because of the stoppage of the fiber feeding device while the opener equipment has continued to run, are not used for piecing but are prevented from this by being removed and being prevented from being incorporated again into the end of the back-fed yarn. The object of the invention thus makes it possible to obtain predetermined conditions for fiber feeding for yarn piecing. At the same time the device is simple in its construction since it is essentially limited to one set of controls, so that the invention can also be applied by retrofitting on machines that have already been delivered.

Examples of embodiments are explained in further detail below with the help of drawings.

DETAILED DESCRIPTION OF THE PREFERRED EMBODIMENTS

Figure 1:
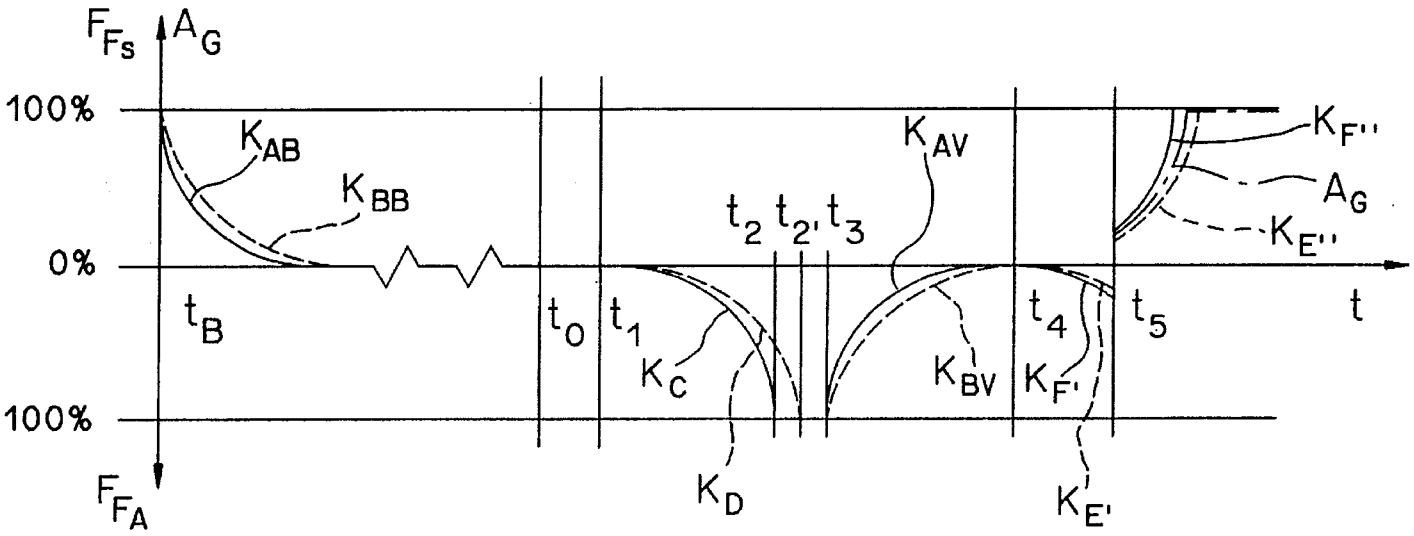
FIG. 1 shows a schematic representation of the runout behavior of the fiber flow after occurrence of a yarn breakage, the run-up and runout behavior of the fiber flow during momentary operation of the fiber feeding device following a longer prior stoppage time, furthermore the run-up behavior of the fiber flow during piecing, when the previously deflected fiber flow is being fed to the spinning element only during the run-up, as well as the acceleration of the yarn withdrawal which is coordinated with the fibber flow.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment may be used with another embodiments to yield a still further embodiment. Additionally, the use of reference characters is consistent throughout the description and drawings, with the same components having the same reference characters.

The device to carry out the process will first be described through FIG. 6 as required to explain the problem to be solved and the new process.

Figure 6:
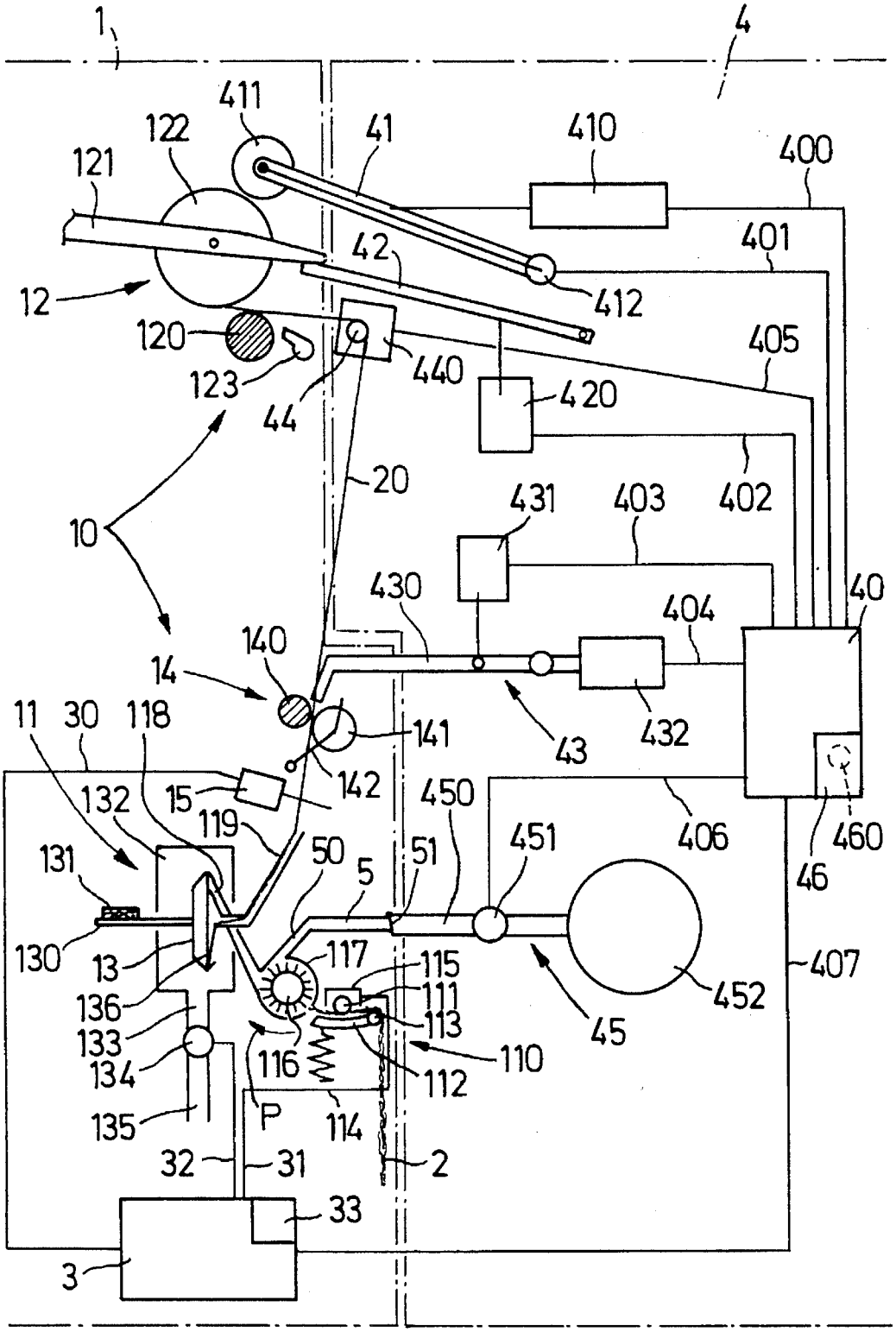
FIG. 6 shows a variant of the rotor spinning device according to the invention shown in FIG. 4 in a schematic side view.

FIG. 6 shows a spinning station 10 of an open-end spinning machine 1 schematically in its left half. This spinning station 10 is provided with an open end spinning device 11 as well as with a winding apparatus 12.

Every open end spinning device 11 is provided with a fiber feeding device 110 to feed a fiber sliver 2 to an opener device 116. The fiber feeding device 110 consists in the shown embodiment of a delivery roller 111 and with a feed trough 112 interacting elastically with roller 111. This feed trough 112 is pivotably mounted on an axis 113 and is pressed elastically against the delivery roller 111 by means of a spring 114. The delivery roller 111 is driven via a controlled coupling 115 by a central drive not shown here.

The opener device 116 in the embodiment shown in FIG. 6 is essentially made in the form of an opener roller located in a housing 117. From it a fiber feeding channel 118 extends to a spinning element 13 which is made in the form of a spinning rotor in the shown embodiment. The spinning element 13 is driven or braked in the usual manner. In the shown embodiment the spinning element 13 in the form of a spinning rotor is provided with a shaft 130 against which a tangential belt 131 is brought to bear or from which it can be lifted away.

The shown spinning element 13 in form of a spinning rotor is provided with a fiber collection surface 136 made in form of a fiber collection groove and is located in a housing 132 equipped with a suction opening 133 which is connected via a controlled valve 134 and a suction line 135 to a negative-pressure source which is not shown here.

A yarn withdrawal pipe 119 is provided to guide the yarn 20 to be withdrawn from the spinning element 13. Withdrawal is effected in the embodiment shown by means of a yarn withdrawal device in the form of a pair of draw-off rollers 14 with a driven draw-off roller 140 and a draw-off roller 141 elastically bearing upon it and driven by it. For this purpose the draw-off roller 141 is mounted on a swivel arm 142.

On its path between the open end spinning device 11 and the draw-off roller pair 14, the yarn 20 is monitored by a yarn monitor 15. The yarn 20 is wound up in the winding apparatus 12 which is equipped for that purpose with a driven winding roller 120. The winding apparatus 12 is furthermore equipped with a pair of swivelling winding arms 121 holding a bobbin 122 rotatably between them. The bobbin 122 bears upon the winding roller 120 during undisturbed spinning and is therefore driven by roller 120. The yarn 20 to be wound up on the bobbin 122 is inserted in a yarn traversing guide 123 which is moved back and forth along the bobbin 122 and ensures uniform distribution of the yarn 20 on the bobbin 122 during winding.

The yarn monitor 15, the coupling 115, and the valve 134 are connected via lines 30, 31 and 32 to a computer or control unit 3 for control.

Alongside the open-end spinning machine 1, which has a plurality of identical spinning stations 10, a service unit 4 is able to travel and is also provided with a control device 40 which is connected via a line 407 for control to the computer or control unit 3 of the open-end spinning machine 1 for the control of the piecing process. The control device 40 is furthermore connected via a line 400 to the swivel drive 410 of a swivel arm 41 on the free end of which an auxiliary drive roller 411 is mounted. The auxiliary drive roller 411 is driven by a drive motor 412 which is also connected for control via a line 401 to the control device 40.

The winding arms 121 of the winding apparatus 12 may be assigned swivel arms 42 which are pivotably mounted on the service unit 4 and whose swivelling drive 420 is connected for control via a line 402 to the control device 40.

A lift-off apparatus 43 can be assigned to the draw-off roller 141 of the draw-off roller pair 14. This lift-off apparatus is provided with a swivel arm 430 which is able to interact with the swivel arm 142 of the draw-off roller 141. For this purpose the swivel arm 430 is connected to a swivel drive 431 and to a lifting drive 432 which are in turn connected via lines 403 or 404 to the control device 40.

The service unit 4 is furthermore equipped with a yarn throw-off device 44 with a drive unit 440 controlled via line 405 by the control device 40.

The outlet 50 of a suction channel 5 lets out in the housing 117 of the opener device 116 into the open-end spinning machine 1, as seen in the direction of fiber movement (arrow P) after the outlet of the fiber feeding channel 118, its end away from the opener device 116 being sealable by a flap 51. A suction channel 450 of a suction device 45 of the service unit 4 can be assigned to the suction channel 5 of the open-end spinning machine 1. This suction channel 450 is connected for control via a valve 451 to a negative-pressure source 452. The valve 451 is in turn connected for control via a line 406 to the control device 40 which contains a timing element 46.

The suction channel 5, the suction channel 450, and the valve 451 together constitute a fiber deflection device. This fiber deflection device is able to assume a fiber stream release position and a fiber stream deflection position. In the fiber stream release position, as shall be described further below, the fibers are conveyed to the fiber collection surface 136. In the fiber stream deflection position, the fibers released by the fiber feeding device 110 are conveyed to a fiber removal device which is constituted by the source 452 of negative pressure, since the flap 51 is opened when a negative pressure is applied to the suction channel 450. The flap 51 assumes its closed position when this negative pressure is missing. As mentioned earlier, this fiber deflection device is connected through its valve 451 or through the drive unit of the latter (not shown) to the control device 40.

Furthermore a known yarn back-feeding device which is not shown here is provided. It is constituted for example by the winding apparatus 12 which can be driven in the back-feeding direction and a yarn feeder 47 (see FIG. 4) with two feed rollers 470 and 471 capable of being driven in the back-feeding direction. However, a yarn guiding hoop or pin can be provided which releases the yarn length required for piecing by swivelling or throwing it off, and which is then fed back to the fiber collection surface 136 as a result of the negative pressure prevailing in the spinning device.

During normal spinning operation, the fiber sliver is fed by means of the fiber feeding device 110 to the opener device 116 which opens the fiber stream into fibers which are conveyed to the fiber collection surface 136 of the spinning element 13 and are deposited there. The end of the yarn 20 being withdrawn is connected to this fiber accumulation which, in the spinning rotor shown as an example of an embodiment, constitutes a fiber ring, and incorporates the fibers into its end as a result of the rotation imparted to it by the rotation of the spinning element 13 while the yarn 20 is withdrawn by the draw-off device 14 from the spinning device 11. The bobbin 122 bears in a known manner upon the winding roller 120 during the spinning process and winds up yarn 20, whereby the yarn traversing guide 123 deposits the yarn in a traversing manner on the bobbin 122.

Figure 2:
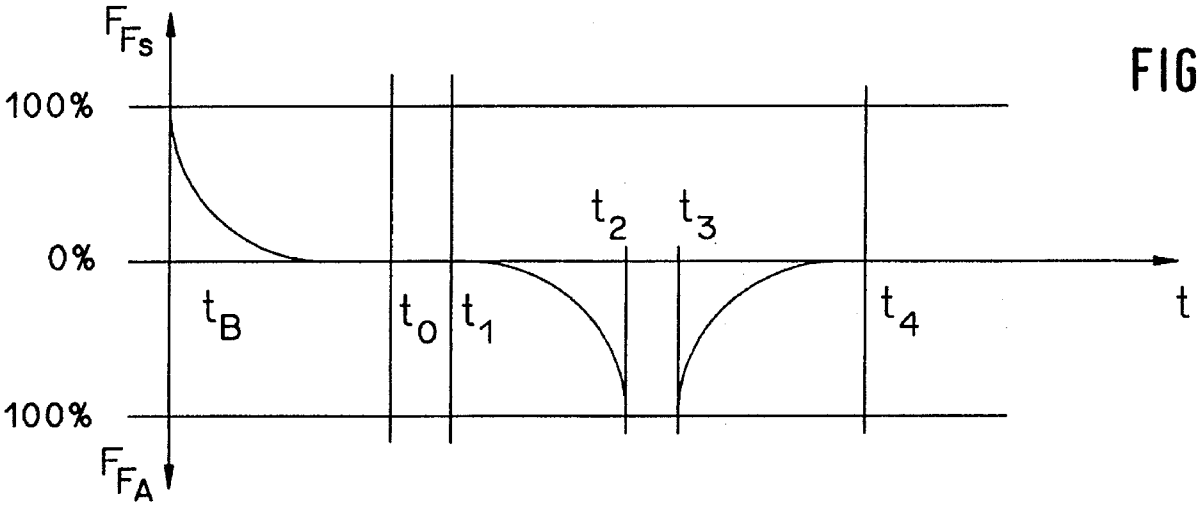
FIG. 2 shows in schematic representation of the runout behavior of the fiber flow after occurrence of a yarn breakage and the run-up and runout behavior of the fiber flow during momentary operation of the fiber feeding device after a short prior stoppage.
Figure 3:
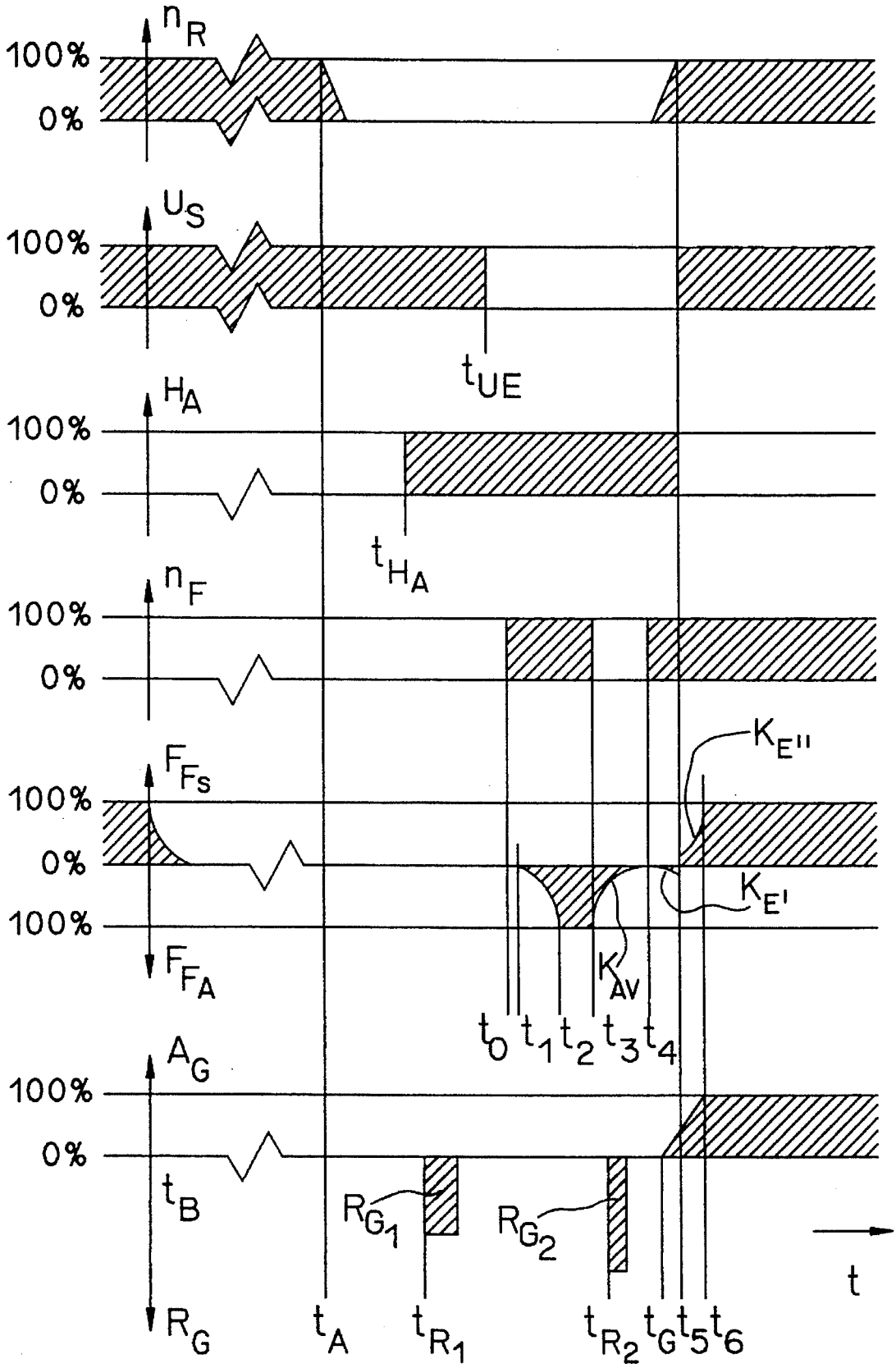
FIG. 3 in the form of a diagram, shows the controls of a spinning rotor, of the negative spinning pressure, of an auxiliary suction air flow, of the fiber feeding device as well as of the resulting fiber flow as well as the controls of the back-feeding and resumed withdrawal of the yarn.

The new piecing process shall now be explained through FIGS. 1 to 3. For the sake of clarity of the drawing the speed of the spinning element 13 which is controlled in the usual manner has not been shown.

The fiber flow $F_{FS}$ taking place in the spinning element 13 is shown on the vertical axis of the diagram by a full or broken ascending line. The yarn withdrawal $A_G$ is shown in a dash-dotted line. The fiber flow $F_{FA}$ which is conveyed to the suction channel 5 and therefore does not go into the spinning element 13 is shown by a full or broken descending line.

The time t is entered on the horizontal time axis.

At the point in time $t_B$ a yarn breakage occurs. At this point in time $t_B$ the fiber feeding device 110 is stopped while the opener device 116, which continues to run, continues to act upon the leading end of the fiber sliver and separates the fibers from it in this process. As more and more time passes, fewer fibers per time unit are combed out of the leading end of the fiber sliver 2, this being a function of the fiber material, of fiber length and of the speed of the fiber feeding device 110 (compare curves $K_{AB}$ and $K_{BB}$). On the other hand the fibers remaining in the sliver end begin to ravel more and more because of the ascending slope of the card clothing. The leading end of the sliver is therefor not in an ideal state for piecing, and for that reason it is desirable to carry out piecing by using those fibers which have not been affected by the prior combing-out process, neither by abrasion nor by tangling/ravelling.

The piecing program is started at the point in time $t_0$. At the point in time $t_1$ the fiber feeding device 110 begins to run, so that the fiber flow $F_{FA}$ resumes. Since the preceding stoppage period has caused the forward end of the fiber sliver, which constitutes a fiber tuft and was presented to the continuously running opener device 116 to be combed out to a greater or lesser extent so that the fiber tuft is now much thinner than during normal production, it must now be advanced for a certain distance until it is again possible to present a fiber tuft which is similar to the one during production to the opener device 116. Furthermore, it is necessary that the fibers presented to the opener device 116 fill the card clothing of the opener device 116 and be conveyed by same. For this a certain amount of time is necessary, and therefore the run-up curve of the fiber flow $F_{FA}$ will be more or less steep.

Since the fibers combed out of the leading end of the fiber sliver have been damaged by abrasion and/or tangling (ravelling) and are therefore impaired, they are prevented from reaching the fiber collection surface 136 of the spinning element 13 and are conveyed instead to the suction channel 5 and are removed by same (see fiber flow $F_{FA}$).

Depending on the material and on the previous damage done to the forward fiber sliver end, the fiber flow $F_{FA}$ reaches its full strength again at different points in time (compare curves $K_C$ and $K_D$ as well as points in time $t_2$ and $t_{2'}$). At a point in time $t_3$ which comes in the most unfavorable case after the point in time $t_2$ or $t_{2'}$, i.e. which is determined so that the continuously withdrawn fiber stream $F_{FA}$ is certain to have reached is full strength, the fiber feeding device 110 is again stopped while the opener device 116 continues to act upon the leading sliver end which is presented to it by the fiber feeding device 110. This momentary operation of the fiber feeding device 110 prevents those fibers which have been damaged by abrasion or tangling during the prior stoppage of the fiber feeding device 110 and which are therefore undesirable for piecing from being deposited on the fiber collection surface 116 of the spinning element 13.

Since the leading sliver end is in the same state at point in time $t_3$ as at point in time $t_B$, since the full fiber flow $F_{FA}$ or $F_{FS}$ was present immediately before these points in time $t_3$ or $t_B$, the runout curves following the points in time $t_B$ and $t_3$ (see also curves $K_{AB}$ and $K_{AV}$ or $K_{BB}$ and $K_{BV}$) of the fiber flow $F_{FS}$ or $F_{FA}$ are also identical. The only difference is that the fiber flow $F_{FS}$ is first conveyed to the spinning element 13 after the occurrence of a yarn breakage, while fiber flow $F_{FA}$ is conveyed after point in time $t_3$ to the suction channel 5 for removal.

The runout curves $K_{AV}$ and $K_{BV}$ continue to flatten out until finally the number of fibers combed out per time unit no longer changes substantially, i.e. to a perceptible extent. Depending on the course of curves $K_{AV}$ or $K_{BV}$ this occurs sooner or later. After a certain time however, the runout curves $K_{AV}$ or $K_{BV}$ essentially come together and coincide in spite of different spinning conditions so that identical conditions now exist in every case, independently of the fiber material processed and independently of the speed of the fiber feeding device 110, i.e. a substantially equal number of fibers is combed out per time unit.

As the fiber feeding device 110 is switched back on, not too long a time may pass so that the fibers combed out as the fiber feeding device 110 is stopped again may not again be affected substantially by abrasion and/or tangling. Instead, the unavoidable damage to fibers due to the stoppage of the fiber feeding device 110 must still be so minimal that it may be disregarded. Accordingly, the point in time $t_4$ when the fiber feeding device 110 is again switched on is set so that on the one hand the different curves $K_{AV}$, $K_{BV}$ have already reached their flat runout aspect while the fiber damage is nevertheless still negligible since these fibers can be discarded.

Even though the starting conditions with respect to the combing out of the leading end of the fiber sliver are substantially identical independently of the material used, the runup curves $K_{E'}$, $K_{E''}$ or $K_{F'}$, $K_{F''}$ will nevertheless vary as a function of various factors. This may depend on the speed of the fiber feeding device 110, for example. It is clear that when the rotational speed of the delivery roller 111 of the fiber feeding device 110 is higher, the fiber stream $F_{FA}$, $F_{FS}$ recovers its full value (100%) sooner than if the fiber feeding device 110 is driven slowly. Similarly, the different materials or also the fiber lengths have an effect on the course of the curve $K_{E'}$, $K_{E''}$ or $K_{F'}$, $K_{F''}$.

The fibers released by switching on the fiber feeding device 110 (at point in time $t_4$) first enter the suction channel 5 and are removed via suction channel 450 (see $K_E$ or $K_F$), so that no fibers reach-the fiber collection surface 136 of the spinning element 13. In this manner the fibers which had lost their optimal state to any, even minimal degree during the brief stoppage of the fiber feeding device 110 after its momentary operation are removed and are thus prevented from taking part later in the resuming spinning process.

At a point in time $t_5$, when the fibers which may have been damaged during the last stoppage of the fiber feeding device 110 have already been removed for the major part, the deflection of the fiber flow is stopped and its conveying to the fiber collection surface 136 of the spinning element 13 is initiated long before reaching the point in time $T_6$ or $t_6$, when the full fiber flow $F_{FA}/F_{FS}$ is reached so that all the fibers go to the spinning element 13 as of point in time $t_5$. Thus the fiber flow $F_{FA}/F_{FS}$ is switched over and fed to the spinning element 13 during the run-up of the fiber flow $F_{FA}/F_{FS}$, i.e. before the fiber stream or fiber flow $F_{FA}/F_{FS}$ started by switching on the fiber feeding device 110 has reached its full operational strength.

At point in time $t_5$ a new adjustment can be made for each case (e.g. for a certain fiber material, a predetermined speed of the fiber feeding device 110, etc.). It is however also possible as an alternative to set the duration of stoppage of the fiber feeding device 110 to be always the same, independently of such variables.

FIG. 2 shows part of the new piecing process after a brief stoppage of the spinning station. Because the opener device 116 continues to run even after stopping the fiber feeding device 110, the fiber tuft is further thinned out, whereby this may be caused solely by the combing out or also by partial abrasion of the fibers of the fiber tuft, depending on the configuration of the fiber feeding device 110. Due to the comparatively shorter time during which the opener device 116 takes effect by comparison to FIG. 1, corresponding to this shorter stoppage time, the fiber tuft is also less affected so that it takes less time before the fiber sliver 2 can again be opened normally by the opener device 116 once the fiber feeding device 110 has been switched on again (compare the interval between the points in time $t_0$ and $t_2$ in FIGS. 1 and 2). The interval between the points in time $t_0$ and $t_2$ is thus shorter according to FIG. 2 than in the case of FIG. 1.

The principle of the new process having been explained, it shall now be explained in further detail in connection with the device the design of which has already been described through FIGS. 5 and 6.

If a yarn breakage occurs (point in time $t_B$), this is signalled by the yarn monitor 15 to the control device 3. At the same time the coupling 115 of the fiber feeding device 110 which stops the delivery roller 111 and thus stops the feeding of more fiber sliver 2 to the opener device 116 is actuated. In a manner not shown here, the bobbin 122 is furthermore lifted up from the winding roller 120 so that the end of yarn 20 can no longer be wound up on the bobbin surface as bobbin 122 continues to run. The opener device 116 however continues to run uninterruptedly.

The service unit 4 eventually reaches this spinning station 10 where yarn 20 has broken. The service unit 4 can also be called to this spinning station by a known calling device which is not shown here; however the service unit 4 can also patrol along a defined number of spinning stations 10 and thus reach the spinning station 10 which is affected by a yarn breakage. When the service unit 4 has reached the affected spinning station 10 its control device 40 interrogates the control device 3 via line 407 and is advised in this manner whether service is required or not at the affected spinning station 10. The control device 3 is designed so that it only transmits that information to the service unit 4 which concerns the spinning station 10 which the service unit 4 has just reached.

If the service unit 4 is at a spinning station 10 requiring service, it stops and starts the piecing program at point in time $t_A$. The spinning element 13 is stopped in the normal manner. Furthermore, the winding arms 121 are lifted in the already described manner by swivel arms 42 from the bobbin lifting device on the machine and are now supported by the swivel arms 42. Furthermore, the auxiliary drive roller 411 is presented to the bobbin 122. The suction channel 450 of the service unit 4 is furthermore presented to the suction channel 5 on the machine. Furthermore the draw-off roller 141 is lifted by means of the lift-off apparatus 43 from the driven draw-off roller 140 and the yarn 20 is drawn off in the usual manner from the bobbin 122 lifted off the winding roller 120 and is fed back into the yarn draw-off pipe 119. In this process the yarn is laid over the yarn throw-off device 44 where it is held. During this time the spinning element 13 is cleaned in the known manner. The fibers and dirt particles cleaned from the spinning element 13 are removed through the suction line 135 by the negative spinning pressure which continues to prevail in housing 132.

Following the cleaning of the spinning element 13 the valve 134 is closed to the negative spinning pressure and the valve 451 is opened to the suction channel 450. Furthermore the previously stopped spinning element 13 is started again and runs up to its production speed or merely to a predetermined piecing speed. The piecing program can be adjusted in such manner in that case that piecing is carried out at a constant speed of the spinning element 13 or during its run-up curve. If piecing takes place at a reduced but constant rotor speed, the spinning element 13 is preferably brought to its production speed so that its run-up curve is substantially synchronized with the speeds of fiber flow $F_{FA}$ and of yarn withdrawal $A_G$ or is at least closely adapted to same.

In coordination with the cleaning of the spinning element 13, an auxiliary suction air stream $H_A$ is brought into action by opening the valve 451 (point in time $t_{HA}$), said suction air stream taking effect through the fiber feeding channel 118 and into the spinning element 13 which is made in the form of a spinning rotor. Since the negative spinning pressure $U_S$ remains switched on as before, the negative spinning pressure $U_S$ as well as the auxiliary suction air stream $H_A$ take effect in the spinning rotor. Thereby a strong air stream flowing in the direction of the spinning rotor is produced in the yarn draw-off pipe 119 and a yarn end previously unwound in the usual manner from the bobbin 122 and prepared for piecing is exposed to it (point in time $R_1$). The yarn end is prevented by the usual means from continued feeding into the spinning rotor.

When the yarn end has reached its readiness position in the yarn withdrawal pipe 119, the auxiliary suction air stream $H_A$ is shut off at point in time $t_{HE}$ by closing the valve 451.

Thereupon (point in time $t_0$) the control device 3 transmits an impulse to the coupling 115 which now switches the fiber feeding device 110 back on. As a result the fiber sliver 2 is again fed to the opener device 116 and goes from the latter through the fiber feeding channel 118 into the spinning rotor without being deposited in same. Instead, the fiber stream $F_{FA}$ produced by switching on the fiber feeding device 110 is conveyed by the still acting negative spinning pressure $U_S$ over the open border of the spinning rotor to the suction line 135 and is removed through it. The fibers which have suffered during the stoppage of the fiber feeding device 110 before the beginning of the piecing process and have therefore been impaired are thereby excluded from subsequent spinning.

At the point in time $t_3$, i.e. once the fiber stream $F_{FA}$ has already reached its full strength (which is the case at point in time $t_2$) the fiber feeding device 110 is again switched off by means of coupling 115.

Even before switching on the fiber feeding device 110 again at point in time $t_4$, the (decreasing) fiber stream $F_{FA}$ following curve $K_{AV}$ is switched over at point in time $t_{HU}$ by switching off the negative spinning pressure $U_S$ and by switching on the auxiliary suction air stream $H_A$ and, instead of being conveyed as before by means of the suction air stream going through the suction line 135, is now removed by the auxiliary suction air stream $H_A$ going through the suction channel 5. The diversion of the (decreasing) fiber stream $F_{FA}$ from its path between the fiber feeding device 110 and the fiber collection surface 136 thus begins after stopping the fiber feeding device 110 which was previously switched on momentarily, but before it is switched on again. To prevent fibers from accumulating on the fiber collection surface 136 which is driven during spinning before this switch-over of the fiber stream $F_{FA}$ released by switching-on the fiber feeding device 110, and thus to prevent them from participating later in the spinning process which is then started by the piecing process, the fibers are deflected at a suitable point in time by suitable synchronization between the run-up of the previously stopped spinning element 13 and the switch-over of the fiber stream (by appropriate control of the negative spinning pressure $U_S$ and of the auxiliary suction air stream $H_A$), and are thus prevented from reaching the spinning element 13, so that the previously stopped fiber collection surface 136 is not yet driven again and therefore has not yet reached a speed such that the fibers which are to be conveyed to it could only be removed from it by a yarn 20 in the process of being withdrawn.

Curve $K_{AV}$ now continues to flatten out until the number of the fibers combed out of the leading sliver end per time unit essentially no longer changes or does no longer change substantially.

This means that now the state of the fiber tuft per time unit also no longer changes or no longer changes substantially, so that by determining the duration of resumed combing-out (time span between points in time $t_3$ and $t_4$) constantly reproducible fiber tuft states and therefore also piecing conditions as a function of the fiber tuft are achieved in the described manner and by simple means. Even before the fibers retained in the fiber sliver 2 which has again been stopped are damaged to such an extent that this damage exceeds a tolerable limit because it was no longer possible to prevent this fiber damage by the still continuing removal of fibers during the subsequent run-up of the fiber stream, the fiber feeding device 110 is finally switched on again by means of coupling 115 at point of time $t_4$ (see rotational speed $N_F$). The fibers combed out of the leading end now constitute an increasing fiber stream $F_{FA}$ which is characterized in FIG. 5 by the curves $K_{E'}$ and $K_{E''}$.

Since the fibers continue to be removed as before by the auxiliary suction air stream $H_A$ the fibers which have again been stressed during the last brief operating period of the fiber feeding device 110 cannot reach the spinning element 13 and are therefore not available for the subsequent piecing and spinning process.

At point in time $t_5$ which is determined by the control device 3, valves 234 and 451 are then actuated so that no more negative pressure is applied to the suction channel 5 and so that instead negative spinning pressure $U_S$ is again applied to housing 132 via suction line 135. At this point in time, fibers which may have been damaged during the brief stoppage of the fiber feeding device 110 have already been removed. The fibers entering the housing 117 of the opener device 116, and which had not been within effective range of the running opener device 116 during the brief stoppage of the fiber feeding device 110 and therefore were not affected during that time, are thereby sucked via fiber feeding channel 118 to the spinning element 13 where they are deposited in the known manner on the fiber collection surface 136.

In a usual manner which is therefore not described in further detail, and in coordination with the release of the fiber flow $F_{FA}$, the yarn 20, the end of which is in a readiness position within the yarn draw-off pipe 119, is fed back into the spinning rotor to such an extent (yarn back-feeding $R_{G2}$) that its end is deposited on the inner wall of the spinning rotor. For this purpose it is necessary for the spinning rotor to be driven again and to produce such a centrifugal force as to enable the yarn end to enter the fiber collection groove (fiber collection surface 136). At a sufficiently early moment the spinning rotor (or an open-end spinning element 13 of some other type) has thereby been accelerated again to an appropriate speed which may be (as indicated earlier) the usual production speed or a special piecing speed, lower than the production speed.

In the control device 3, the manner in which the fiber flow $F_{FA}/F_{FS}$ increases again (as a function of fiber material, fiber staple length, configuration of the fiber feeding device 110, etc.) is stored. This also makes it is possible to control fiber withdrawal $A_G$ and to adapt the increase of the fiber flow $F_{FS}$ as a function of this curve if desired. Yarn withdrawal $A_G$ is switched on by the control device 3 via control device 40 of the service unit 4 at point in time $t_5$ when the fiber flow $F_{FS}$ begins in the spinning element 13 (see curve $K_{E''}$) or shortly before, or even after this point in time $t_5$ and is accelerated in accordance with the curve indicated by the control device 3. This acceleration can be controlled so as to be linear or follow any desired curve, depending on a run-up curve of fiber flow $F_{FS}$ entered into the control device 3, i.e. as a function of the increased effect of the fiber flow $F_{FS}$ on the fiber collection surface 136.

Control is effected here by means of the auxiliary drive roller 411. It is however also possible to control the yarn withdrawal curve by means of the draw-off roller 141 by controlling the contact pressure of the draw-off roller 141 by means of the lift-off apparatus 43.

At point in time $t_6$ fiber flow $F_{FS}$ has reached its full strength. Thus the draw-off roller 141 can again be brought to bear against the driven draw-off roller 140 by means of the lift-off apparatus 43 of the draw-off roller 141 after this point in time $t_6$ and the withdrawal of yarn 20 from the open end spinning device 11 can be effected by means of the draw-off device 14. The bobbin 122 can now be lowered on the winding roller 120, whereupon the auxiliary drive roller 411 is lifted from the bobbin 122.

If desired, the spinning element 13 can also be accelerated from piecing speed to production speed in accordance with the run-up of the fiber flow $F_{FS}$.

Setting the point in time $t_3$ appropriately ensures that the fiber flow $F_{FA}$ in the previously-described embodiment is certain to have reached its full value (100%) during the momentary operation of the fiber feeding device 110, independently of the course of curve $K_c$ or $K_D$. For this, it is however not necessary to determine the time interval between the points in time $t_0$ and $t_3$ according to the flattest possible curve $K_D$. Instead, the combed-out state of the fiber tuft can be used as a basis for the control of the intermediate feeding since the combed out state of the fiber tuft is the determining factor for the course taken by curve $K_C$, $K_D$.

This state can be measured in different manners, i.e. directly or indirectly; this is done before the start of momentary operation of the fiber feeding device 110. The combed-out state of the fiber tuft is for instance derived indirectly from the time interval between the stopping of the fiber feeding device 110 and the beginning of the piecing process while the opener device 116 continues to run. For this purpose a time measuring element 33 is provided in the control device 3 as shown in FIG. 5 to measure the time from the stoppage of the fiber feeding device 110 until the start of the piecing process. This time is shown in FIG. 5 by the time interval between points in time $t_B$ and $t_A$. As a function of the length of this time span, the duration of switching on the fiber feeding device 110 (between points in time $t_1$ and $t_3$) is set for the intermediate feeding.

As an alternative to the time measuring device 33 which can also determine the points in time $t_3$, $t_4$ and $t_G$ in the open-end spinning machine 1 if necessary, it is also possible to provide input means (setting knob 460) for the time control element 46 on the service device on the service unit in order to set time $t_G$. This can be done as a function of different factors (state of the fiber tuft, fiber material, staple fiber length, distance between the nip between delivery roller 111 and feed trough 112, or other counter-elements interacting with the delivery roller 111 and the operating area of the opener device 117, etc.).

As a comparison between curves $K_C$ and $K_D$ (FIG. 1) shows, the maximum-strength fiber stream $F_{FA}$ is attained as a function of the preceding stoppage time (between points in time $t_B$ and $t_0$) at different points in time (see points in time $t_2$ and $t_2$). Piecing time can be shortened by not selecting point in time $t_3$ so that it is always at the same interval from point in time $t_O$, but by selecting it in function of the preceding stoppage time. The stoppage time is the time during which the opener device 116 has acted upon the leading end (fiber tuft) of the fiber sliver 2 which had previously been stopped by switching off the fiber feeding device 110 before the beginning of the momentary operation of said fiber feeding device 110.

The state of the fiber tuft need not be derived from the stoppage time of the fiber sliver 2 (while taking possibly other factors into account), but can very well be determined by some other method, e.g. optically, by measuring the air resistance, etc., if this is desired. Accordingly, the duration of the momentary operation of the fiber feeding device 110 as well as the control of yarn withdrawal $A_G$ can also be determined directly as a function of the state of the leading end of the fiber tuft 2.

As indicated above, there is a phase when the fiber stream $F_{FA}$ decreases (curve $K_{AV}$, $K_{BV}$) during which the number of fibers combed out of the leading end of fiber sliver 2 per time unit changes only barely or insignificantly. This phase is characterized by a very flat course of the curve. Independently of different factors which could influence the course of curve $K_{AV}$, $K_{BV}$ in any manner, the curves $K_{AV}$, $K_{BV}$ sooner or later coincide.

During the entire time during which the curve $K_{AV}$, $K_{BV}$ flattens out, the stopped fiber tuft remains within influence range of the still running opener device 116 which has a damaging effect on the fibers contained in the fiber tuft, even if it affects the state of the fibers only to an insignificant degree. Therefore the time during which the fiber tuft is exposed to the continuously running opener device 116 while the fiber feeding device 110 is stopped cannot be selected to be of any length, but should be so brief that the fibers which are exposed to the opener device which continues to run during the stoppage time of the fiber feeding device 110 after the latter's momentary operation are taken away and thus removed during the relatively brief time span between switching the fiber feeding device 110 back on and the beginning of fiber feeding to the fiber collection surface 136, i.e. between points in time $t_4$ and $t_5$, so that practically undamaged fibers are again available for piecing.

While taking into account the two above-mentioned requirements, —i.e. first of all combing out until a point of time is reached when the number of fibers combed out per time unit no longer changes significantly, and secondly only insignificant and therefore negligible damage is inflicted upon the fibers contained in the stopped fiber tuft which continues to be exposed to the continuously running opener device 116 which can be removed in major part during the first phase of the fiber stream as it runs up again by being taken away—a point in time $t_4$ when the fibers are released again after the brief stoppage of the fiber feeding device 110 can be optimally determined so that the time during which the fiber feeding device 110 is again switched off after its momentary operation (i.e. the time between points in time $t_3$ and $t_4$) can always be selected to be equal duration, independently of the material to be spun.

The time from the moment when the fiber feeding device 110 is switched on again after its brief stoppage until the fiber stream $F_{FA}$ is switched over, i.e. the time between the points in time $t_4$ and $t_5$, can be determined in different manners. If for example a monitoring device is assigned to the fiber feeding device 110, i.e. to its delivery roller 111, the time can be determined as a function of a predetermined angle of rotation of the delivery roller 111. At a given rotational speed of the delivery roller 111, such a defined angle of rotation represents a certain time span. This type of timely determination is especially advantageous because the length of fiber sliver 2 which is conveyed in this manner within the set time span is known, so that a coordination with the fiber sliver length which may have been affected by the continuously running opener device 116 during the brief stoppage of the fiber feeding device 110 can be achieved thereby.

However, the fiber sliver length which has suffered damage at an identical stoppage time of the fiber feeding device (as the opener device 116 continues to run) does not depend only on the time during which the stopped fiber tuft is exposed to the action of the opener device 116, but also on the type of fiber material (e.g. cotton or synthetics, long or short fibers). For this reason, the fiber material is taken into account in the described embodiment when determining the time span from the moment when the fiber feeding device 110 is switched on at point in time $t_4$ until the now again increasing fiber stream is switched over (point in time $t_5$) by the control device 3 and/or 40 additionally or alternatively to the described process. For this purpose, the type of fiber material is entered by means of the adjusting knob 460 (see FIG. 6) before the beginning of operation when changing batches, and this type of fiber material is then taken into account by the control connections between the control devices 3 and 40 in determining the above-mentioned time span. To enable to control device 3 and/or 40 to take the input into account, it is made as a computer or contains such a computer by means of which it is able to correct times which are indicated in or by means of the time control device (time measuring element 46). Instead of the control device 3 and/or 4 controlling indicated times, provisions are alternatively made for the computer of the control device 3 and/or 4 to first calculate and determine the times to be observed.

In an alternative process the yarn 20 is monitored during piecing by means of a yarn monitoring device (yarn monitor 15) for thickness fluctuations. If the piecing joint thickness deviates from a desired thickness entered suitably into the control device 3 or 4, this leads to a storage of the actual value of the piecing joint and, depending on the determination made, to a yarn breakage with immediate repetition of the piecing process. In any case at least the time from the moment when the fiber feeding device 110 is switched back on until the beginning of fiber conveying to the fiber collection surface 136 is controlled here as a function of the success obtained in completing the piecing joint. In principle, the crucial times can be modified or determined for a piecing process to be carried out (immediately or later) through a modified determination of the points in time $t_4$ and/or $t_5$ and/or $t_G$, and the run-up course of the yarn withdrawal $A_G$ can be modified or determined as a function of a program stored in the control device 3 or 4 so that an optimized piecing joint is now obtained.

The points in time $t_4$, $t_5$, $t_G$, and thereby the switching times can be entered in this case by the control device 3 or 40 or by their time control element 46 at first as standard values or can be entered manually before the start of spinning by means of the adjusting knob 460, depending on the design of the control device 3 or 40. In any case the fiber deflection device is deflected (by means of its valve 451) into its fiber stream deflection position, or back into its fiber stream release position in synchronization with the fiber feeding device 110 being switched on and/or off.

During back-feeding of the yarn end into its readiness position inside the yarn draw-off pipe 119, a relatively high negative pressure is desired as this increases the reliability of back-feeding. Later the intensity of the negative pressure no longer plays such a crucial role. For this reason provisions are made in the embodiment described above for the auxiliary suction air stream $H_A$ to be switched off momentarily (point in time $t_{HE}$) and to be then switched back on (point in time $t_U$) so that the auxiliary suction air stream $H_A$ may take effect in time, before the previously momentarily operating fiber feeding device 110 is switched back on. It is however also possible to dispense with this momentary switching off of the auxiliary suction air stream $H_A$, as is indicated by a broken line in FIG. 5.

The described process and the indicated connections can be varied in many different ways, e.g. by replacing certain individual characteristics by equivalents or through some different combinations thereof. Thus it is not necessary, for example, to make the spinning element 13 in form of a spinning rotor, but different open-end spinning elements, e.g. friction spinning rollers, etc. can very well be used. Nor is it necessary to provide a separate negative-pressure source 452 on the service unit 4, as the suction channel 450 can also be connected on a negative-pressure source on the machine, to which the suction line 135 is also connected.

It is also possible to drive the draw-off roller 140 via a controlled slip coupling (not shown) from a drive shaft and to control the yarn withdrawal $A_G$ in function of current slippage.

Figure 4:
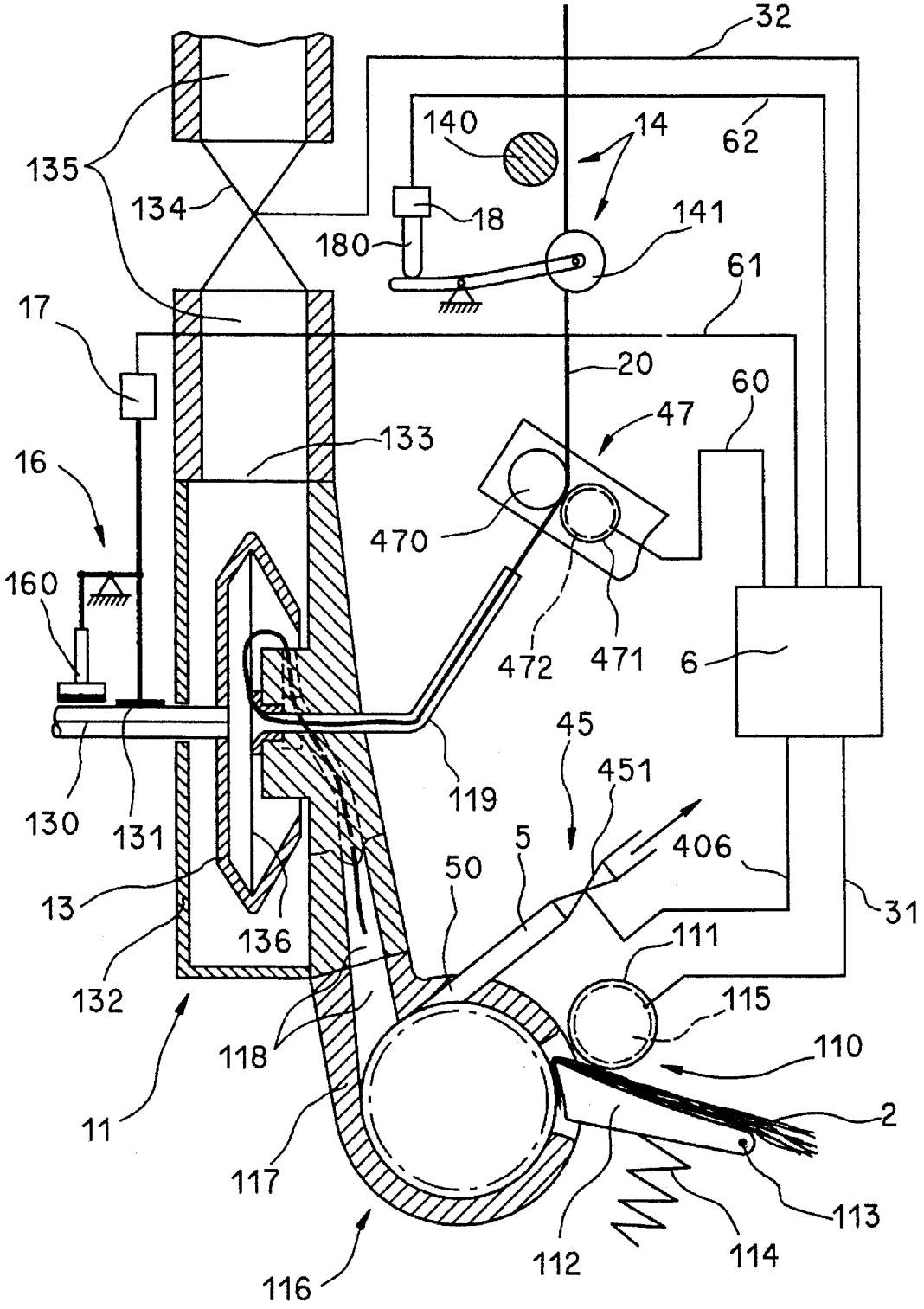
FIG. 4 shows a rotor spinning device designed in accordance with the invention, in a schematic side view.

Another variant is shown in FIG. 4 in which only those parts which are necessary to understand the invention are represented. These parts may be divided up as usual between the open-end spinning machine itself and a service unit travelling alongside the machine. They are essentially the parts which are also shown in FIG. 6 and therefore need not be explained again hereinafter. Instead of two control devices 3 and 40, one single control device 6 is shown in FIG. 4 since a division between the open-end spinning machine and the service unit is not shown in this drawing, but it is obvious that a division of the control device 6 in the manner shown in FIG. 6 is perfectly possible.

The spinning element 13 shown in this embodiment is again made in form of a spinning rotor and can be driven or braked via its shaft 130—in the same manner as in the embodiment shown in FIG. 6. Via rods 16—or merely via suitable controls—the drive belt 131 or a brake 160 can selectively be brought to bear upon shaft 130, and for this purpose one or several corresponding drives 17 are assigned to the drive belt 131 and to the brake 160 to control the required movements.

The non-driven roller 141 which thus constitutes a pressure roller is mounted on the free end of a two-armed lever 142 the other free end of which can be subjected to the force of a ram 180 which may be constituted by the armature of an electrical magnet 18, for instance.

FIG. 4 shows a pivotably mounted yarn feeder 47 equipped with feed rollers 470 and 471 which can be moved away from each other so that a yarn 20 produced in the spinning rotor (spinning element 13) can be pulled through the open roller pair. Of the feed rollers 470, 471, at least the feed roller 471 can be driven by means of a motor 472.

As shown in FIG. 4, the coupling 115 of the spinning station 10 is connected via line 31, the valve 451 via line 406, the yarn feeder 47 which may also be part of a yarn back-feeding device via a line 60, drive 17 (brake device 160) via a line 61, the electrical magnet 18 of the roller pair 14 (draw-off rollers 140, 141) via a line 62 and the valve 134 in the negative-pressure line 135 via line 32 to the common control device 6 which controls the entire piecing process. Other lines connected to the elements are provided, but are not of significant importance for the object described here.

The spinning process takes place in the usual manner also with this embodiment. Therefore only piecing is described hereinafter with the help of FIGS. 3 and 4.

If a yarn breakage occurs for any reason, or if the spinning device has been stopped for other reasons, it is necessary to carry out a piecing process in order to start the spinning process, said piecing process being described below insofar as it is different from the piecing process already described or insofar as it can be described in a more detailed manner through FIG. 3 based on the additional elements shown.

Following the cleaning of the spinning element 13, after preparation of the yarn end to ensure that it is given an optimal form for piecing and after back-feeding the yarn end into a readiness position inside the yarn draw-off pipe 119 (point in time $t_{R1}$) by means of the combined effect of negative spinning pressure $U_S$ and auxiliary suction air stream $H_A$, the negative spinning pressure $U_S$ is switched off by closing valve 134 so that only the auxiliary suction air stream $H_A$ takes effect through housing 117 and fiber feeding channel 118 and into the yarn draw-off pipe 119.

The momentary feeding of fibers to the opener device 116 then takes place in the manner described above, by switching on the fiber feeding device 110, whereby the fibers are prevented from entering the spinning element 13 made in form of a spinning rotor. They are instead removed through suction channel 5/450.

In coordination with points in time $t_3$ and $t_4$(switching off the fiber feeding device 110 and switching it back on), the yarn feeder 47 consisting of the feed rollers 470 and 71 is opened. In addition the yarn 20 is released to be back-fed in a known manner. The auxiliary suction air stream $H_A$ keeps the released yarn 20 under tension and pulls its end out of the yarn draw-off pipe 119 into the spinning rotor, without letting it reach the circumferential wall of the latter, and finally into the fiber feeding channel 118 (point in time $t_{R2}$). During this time the fibers which continue to be combed out due to the continuing running of the opener device 116 continue to be removed from the leading end of the fiber sliver 2 as before with the help of the auxiliary suction air stream $H_A$, without coming into contact with the yarn end located in the fiber feeding channel 118.

The spinning rotor is released from the brake 160 which was braking until then in similar coordination with the switching off and switching on again of the fiber feeding device 110 through actuation of the drive 17 (or of the drives 17), while the drive belt 131 is again brought into contact with the shaft 130 of the spinning element. The spinning rotor thus runs up, whereby suitable measures may be taken so that the spinning rotor is not immediately brought to its full production speed but merely to a somewhat lower piecing speed. An additional drive belt (not shown) driven at piecing speed and used for the duration of piecing instead of drive belt 131 can be provided for example to drive the spinning rotor.

The fiber feeding device 110 is switched back on in coordination with this. The reciprocal coordination of release of the spinning rotor and switching on the fiber feeding device 110 is such that the spinning rotor has reached the rotational speed provided for piecing (special piecing or also full production speed) before the valves 151 and 134 are switched over simultaneously. Therefore normal negative spinning pressure $U_S$ is again present in the spinning rotor while the auxiliary suction air stream $H_A$ has been taken out of action. Consequently an air stream is produced in the fiber feeding channel 118 which is now oriented in the direction going from the opener device 116 to the spinning rotor. The yarn end which was held in the fiber feeding channel 118 until then is sucked out of the fiber feeding channel 118 by this air stream and is deposited on the rotating rotor wall due to the centrifugal force produced by the rotating spinning rotor, from where the yarn end is deposited into the fiber collection groove (fiber collection surface 136) at the location where the inner circumference of the spinning rotor is greatest.

Simultaneously with the yarn end being deposited in the rotating spinning rotor 1, the fibers detached from the fiber tuft by the opener roller 31 now also enter the fiber feeding channel 118 and go from there into the fiber collection groove of the spinning rotor so that the fibers are incorporated into the end of the yarn being fed to the fiber collection surface 136 (fiber collection groove).

In synchronization with the switching over of the air stream in the fiber feeding channel 118, i.e. upon the closing of valve 451 and opening of valve 134, the bobbin 122 which was stopped until then is again driven in winding direction so that the yarn end is again withdrawn from the spinning rotor (spinning element 13). The fibers are then incorporated in a known manner and continuously into the continuously withdrawn yarn end.

Upon completion of the piecing process the drive of the open-end spinning machine 1 may be switched over to the shown drive belt 131, causing the spinning rotor to be brought to normal production speed.

If the piecing yarn has been fed back for piecing from a special piecing bobbin, it is cut in a known manner and thereby separated from the piecing bobbin while the yarn 20 which is being withdrawn continuously from the spinning rotor is transferred to bobbin 122 and is wound up on it.

In this manner normal production conditions apply again.

Figure 5:
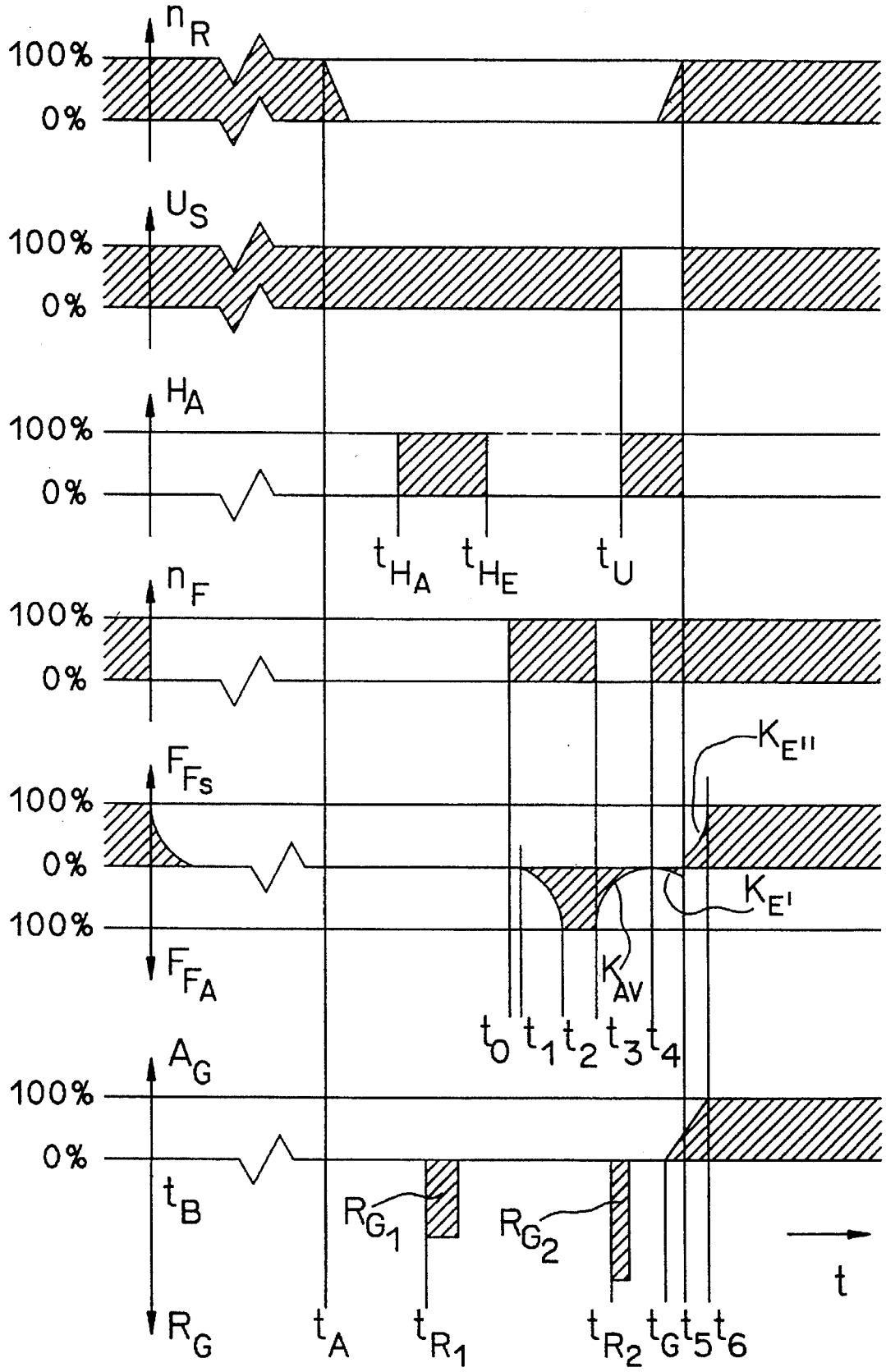
FIG. 5 in the form of a diagram, shows the controls of a spinning rotor, of the negative spinning pressure, of an auxiliary suction air stream, of the fiber feeding device as well as of the resulting fiber flow as well as the controls of back-feeding and resumed withdrawal of the yarn in a variant of the process shown in FIG. 3.

It goes without saying that the variations of the process discussed through FIGS. 5 and 6, insofar as they are not determined by the differing control of the negative spinning pressure $U_s$ and of the auxiliary suction air stream $H_A$, can also be applied to a variant of the process and of the device according to FIGS. 3 and 4.

In an equivalent manner and with the help of both described devices, it is possible with the discussed process for the run-up curves which are determining for piecing ($K_E$, $K_{E''}$, or $K_F$, $K_{F''}$) to remain within a tolerable fluctuation range so that the magnitude of the fiber stream $F_{FA}$, $F_{FS}$ at point in time $t_5$ when this fiber stream is switched over is substantially known in order to determine the beginning of the fiber feeding to the fiber collection surface 136 of the spinning element 13. This is the condition for precise piecing and for an essentially consistent aspect and strength of the piecing joint.

It will be apparent to those skilled in the art that various modifications and variations can be made in the present invention without departing from the scope and spirit of the invention. For example, features illustrated or described as part of one embodiment may be used with another embodiment to yield a still further embodiment. It is intended that the present invention cover such modifications and variations as come within the scope of the appended claims and their equivalents.

We claim:

1. A process for piecing in an open-end spinning device having a fiber collection surface, an opener device, and a fiber feeding device for feeding a fiber sliver to the opener device, the fiber feeding device having been switched off prior to said piecing, said process comprising:

switching the fiber feeding device on for a predetermined period of time sufficient so that fibers which are undesired for piecing are combed out of the leading end of the fiber sliver presented to the opener device;

deflecting the combed out undesired fibers from the fiber collection surface;

switching the fiber feeding device off after the predetermined period of time once the undesired fibers have been combed out of the fiber sliver;

maintaining the fiber feeding device in an off condition for a relatively short period of time so that the fibers remaining in the leading end of the fiber sliver are only minimally damaged by the opener device;

switching the fiber feeding device back on and deflecting the fiber stream produced from the fiber collection surface as the fiber stream increases to full strength wherein the fibers which were only minimally damaged during the relatively short period of time the fiber feeding device was maintained off are prevented from reaching the fiber collection surface; and subsequently deflecting the increasing fiber stream to the fiber collection surface for piecing in coordination with backfeeding of a yarn end to the fiber collection surface before the fiber stream reaches its full production strength.

2. The process as in claim 1, further comprising determining the duration of the predetermined period of time the fiber feeding device is switched on as a function of the length of time the opener device acted on the leading end of the fiber sliver before said switching on of the fiber feeding device for the predetermined period of time.

3. The process as in claim 1, further comprising determining the duration of the predetermined period of time the fiber feeding device is switched on as a function of the combed out state of the leading end of the fiber sliver before said switching on of the fiber feeding device for the predetermined period of time.

4. The process as in claim 1, wherein the period of time said fiber feeding device is maintained in an off condition after said switching on for said predetermined period of time is the same regardless of the type of sliver material such that the number of fibers combed out per unit of time while the fiber feeding device is maintained in an off condition is relatively constant when subsequently switching the fiber feeding device back on for piecing.

5. The process as in claim 1, wherein the fiber collection surface is made in the form of a fiber collection groove of a spinning rotor and fibers are deflected to the fiber collection groove through a fiber feeding channel, and a yarn withdrawal pipe is provided for directing spun yarn away from the fiber collection groove, said process further comprising:

while maintaining the spinning rotor stopped and before said switching on of said fiber feeding device for said predetermined period of time, drawing a yarn end into a readiness position with the yarn withdrawal pipe through combined effect of a negative spinning pressure established in the spinning rotor and an auxiliary suction air stream drawn through the fiber feeding channel;

coordinating stopping the negative spinning pressure in the spinning rotor with said switching on of the fiber feeding device for the predetermined period of time so that the auxiliary suction air stream acting through the fiber feeding channel draws the yarn end into the fiber feeding channel and also deflects the undesired combed out fibers away from the fiber collection groove without contacting the yarn end within the fiber feeding channel, maintaining the auxiliary airstream in the fiber feeding channel after the fiber feeding device is switched off after the predetermined period of time;

coordinating switching on and driving the spinning rotor to production speed with said subsequent switching on of the fiber feeding device while maintaining the auxiliary air stream in the fiber feeding channel;

switching the negative spinning pressure back on in the spinning rotor while switching off the auxiliary air stream as the fiber stream is increasing to full production strength so as to convey the fiber stream and yarn end to the spinning rotor for piecing.

6. The process as in claim 1, wherein the fiber collection surface is a fiber collection groove defined in a spinning rotor which has an open border wherein a suction air stream is produced which leaves the spinning rotor via its open border, said process further comprising sucking away the fibers combed out of the leading end of the fiber silver during the predetermined period of time the fiber feeding device is switched on over the open border of the spinning rotor.

7. The process as in claim 6, wherein said deflecting the combed out undesired fibers from the fiber collection surface begins after said switching off of the fiber feeding device after said predetermined period of time.

8. The process as in claim 7, further comprising driving the fiber collection surface to a production speed after said switching off of the fiber feeding device after said predetermined period of time and deflecting said combed out undesired fibers from the fiber collection surface before said driving of the fiber collection surface to production speed.

9. The process as in claim 1, wherein the time from said switching the fiber feeding device back on and said subsequently deflecting the increasing fiber stream to the fiber collection surface for piecing is determined as a function of conveyed sliver length.

10. The process as in claim 1, wherein the time from said switching the fiber feeding device back on and said subsequently deflecting the increasing fiber stream to the fiber collection surface for piecing is determined as a function of sliver material.

11. The process as in claim 1, further comprising monitoring yarn production and adjusting the time from said switching the fiber feeding device back on and said subsequently deflecting the increasing fiber stream to the fiber collection surface for piecing is determined as a function of obtaining successful piecing joints.

12. The process as in claim 1, further comprising withdrawing the newly pieced yarn from the fiber collection surface at a rate corresponding to the rate of increase of the fiber stream arriving at the fiber collection surface after said deflecting of the fiber stream to the fiber collection surface before the fiber stream reaches full production strength.

13. An open-end spinning device, comprising:

a drivable fiber collection surface for spinning fibers conveyed thereto into yarn;

a controllable fiber feeding device and associated opener device for, said opener device opening a leading end of a fiber silver conveyed thereto by said fiber feeding device into fibers to be conveyed to said fiber collection surface;

a fiber deflection device operably disposed between said fiber feeding device and said fiber collection surface, said fiber deflection device having a fiber stream release configuration wherein a fiber stream is conveyed to said fiber collection surface, and a fiber deflection configuration wherein the fiber stream is conveyed to a fiber removal device;

a yarn backfeeding device configured to feed a yarn end into said fiber collection surface for piecing, and a yarn withdrawal device configured to withdrawal newly formed yarn from said fiber collection surface;

a piecing control device in operable communication with said fiber feeding device and said fiber deflection device to control piecing, said control device including a timing mechanism configured to cause switching said fiber deflecting device to said fiber deflection configuration and for switching on said fiber feeding device for a predetermined period of time after a yarn break and prior to piecing so as to comb out undesired fibers from said leading end of said sliver and deflecting them from the fiber collection surface, said control device and timing mechanism configured to subsequently switch off said fiber feeding device after said predetermined period of time for a second predetermined period of time calculated to cause only minimal damage to said leading end of said sliver and to subsequently switch on said fiber feeding device after said second predetermined period of time, said control device coordinating switching of said fiber deflection device from said fiber deflection configuration to said fiber release configuration after said switching on of said fiber feeding device after said second predetermined period of time and prior to the fiber stream reaching full production strength.

14. The open-end spinning device as in claim 13, further comprising an input mechanism in communication with said control device to allow an operator to vary said first and second predetermined periods of time according to corrections entered in said control device through said input mechanism.

15. The open-end spinning device as in claim 13, further comprising a yarn monitor operably disposed to monitor yarn thickness fluctuations of newly produced yarn from said fiber collection surface, said yarn monitor in communication with said control device so as to vary one of said first and second predetermined periods of time based upon obtaining acceptable piecing joints.

* * * * *